United States Patent [19]

Barbano et al.

[11] 4,286,271

[45] Aug. 25, 1981

[54] LOG-PERIODIC MONOPOLE ANTENNA

[75] Inventors: Normand Barbano, Sunnyvale; Samuel C. Kuo, Saratoga, both of Calif.

[73] Assignee: GTE Products Corporation, Stamford, Conn.

[21] Appl. No.: 15,493

[22] Filed: Feb. 26, 1979

[51] Int. Cl.[3] ..... H01A 11/10

[52] U.S. Cl. ..... 343/792.5; 343/846

[58] Field of Search ..... 343/792.5

[56] References Cited

U.S. PATENT DOCUMENTS

| | | | |
|---|---|---|---|
| 2,977,597 | 3/1961 | Du Hamel et al. | 343/792.5 |
| 3,271,775 | 9/1966 | Yang | 343/792.5 |
| 3,355,740 | 11/1967 | Mayes | 343/792.5 |
| 3,383,693 | 5/1968 | Kahn et al. | 343/792.5 |
| 3,696,430 | 10/1972 | Cory et al. | 343/792.5 |

FOREIGN PATENT DOCUMENTS

| | | | |
|---|---|---|---|
| 1133777 | 7/1962 | Fed. Rep. of Germany | 343/792.5 |

*Primary Examiner*—Eli Lieberman

*Attorney, Agent, or Firm*—John F. Lawler

[57] ABSTRACT

A vertically-polarized log-periodic monopole antenna comprises two closely spaced arrays of elements over a ground plane and connected to a balanced feed source, i.e, the arrays are separately excited out of phase by the source. The elements of each array taper from minimum dimensions at the feed end to maximum at the other end in progressive increments of a predetermined ratio $\tau$ and are open at their inner ends proximate to the ground plane. Each array preferably comprises an electrically continuous wire-like conductor configured to define the profile of the elements and to constitute the interelement connecting lines. Preferred shapes of the elements are trapezoidal, pseudo-trapezoidal and triangular. The antenna provides very broadband (20 to 750 MHz) frequency independent performance at minimum VSWR (<2.0 to 1) and has non-critical design parameters.

14 Claims, 6 Drawing Figures

LOG-PERIODIC MONOPOLE ANTENNA

BACKGROUND OF THE INVENTION

This invention was made under a contract with the Department of the Army.

This invention relates to an improved log-periodic monopole antenna. The term "monopole" as used herein refers to an antenna having driven or radiating elements that are approximately one-quarter wavelength long at the operating or radiating frequencies and which are electrically isolated from an electrically conductive ground plane to produce a radiation pattern approximating that of dipoles.

The need for a very broad band vertically polarized HF (2–30 MHz) VHF (30–300 MHz) monopole antenna which can be mounted over a ground plane has long been recognized. Such antennas are useful for communications, direction finding, surveillance, and electronic countermeasures. While such performance can be obtained from the conventional log-periodic dipole antenna, the height of the latter at the low frequency end is impractical i.e., 250 feet at 2 MHz. In addition, the antenna must be elevated substantially above the ground to avoid periodic gain drop-out in which the radiation pattern breaks up at spaced frequencies across the band. The reduction in antenna height afforded by the monopole version is approximately ½ that of the dipole version as is well known in the art and is described in an article entitled, "Log-Periodic Monopole Array" by Berry et al, 1961 IRE International Convention Record, Part 1, Mar. 20–23, 1961, pages 76–85.

In order that any log-periodic antenna, including the monopole version, may produce backfire radiation patterns, the phase of an applied electromagnetic signal must be shifted 180° between adjacent antenna elements. This has been accomplished in the past with a log-periodic monopole antenna by interspersing parasitic elements between the active or driven elements. Such an antenna is described in U.S. Pat. No. 3,286,268. While this design incorporates the necessary phase reversal between adjacent drive elements, the antenna has the disadvantage that the relative positions of the parasitic elements with respect to the active elements are very critical to the performance of the antenna. This not only places somewhat narrow limits on mechanical design tolerances but also requires that all radiating elements be rigidly mounted to maintain their relative positions during operation in order to insure acceptable performance characteristics. Furthermore, experience with this antenna indicates the need for improvement of repeatability and predictability of performance.

Another related prior art structure is described in a report entitled, "Bent Log-Periodic Zigzag Antenna" by J. G. Greiser, Supplement to Interim Engineering Report No. 4 for Broadband Wide Aperture Radio Location Antenna System, University of Illinois, May 31, 1962. In this structure, every other element functions as a radiator while intermediate elements are bent orthogonally to the radiating element and are used as phase-adjusting stubs. These stubs, being very close to the ground plane, behave as transmission lines, do not radiate, and provide the necessary phase reversal between adjacent elements. A difficulty with this antenna is its size in the horizontal plane. For example, while operating at a frequency of 2.0 MHz, the longest phasing stub is in the neighborhood of 12 feet. Other disadvantages are (i) the critical spacing between the antenna and ground plane required to maintain a good input impedance match, and (ii) the non-uniformity of tapers of radiating elements and phasing stubs resulting in increased difficulty in the design and fabrication of the antenna.

This invention is directed to a log-periodic monopole antenna which overcomes these disadvantages.

OBJECTS AND SUMMARY OF THE INVENTION

An object of this invention is the provision of a log-periodic monopole antenna which is relatively compact in the horizontal plane.

A further object is the provision of such a monopole antenna having relatively non-critical design parameters which results in flexible structural tolerances that are readily and economically achieved during construction of the antenna.

Still another object is the provision of a log-periodic monopole antenna having increased efficiency and improved pseudo-frequency independent performance.

Still another object is the provision of a log-periodic monopole antenna having predictable and repeatable electrical performance characteristics.

These and other objects of the invention are achieved with a log-periodic monopole antenna having two juxtaposed planar arrays of log-periodic elements disposed normal to and over a ground plane and fed 180° out of phase at their smaller ends by a balanced feed device. The elements in each array are open adjacent to the ground plane and each element is configured in a plane rectilinear shape by a conductor which defines the profile of the element and forms part of the feed or transmission line for the associated array.

DESCRIPTION OF PREFERRED EMBODIMENTS

Figure 1:
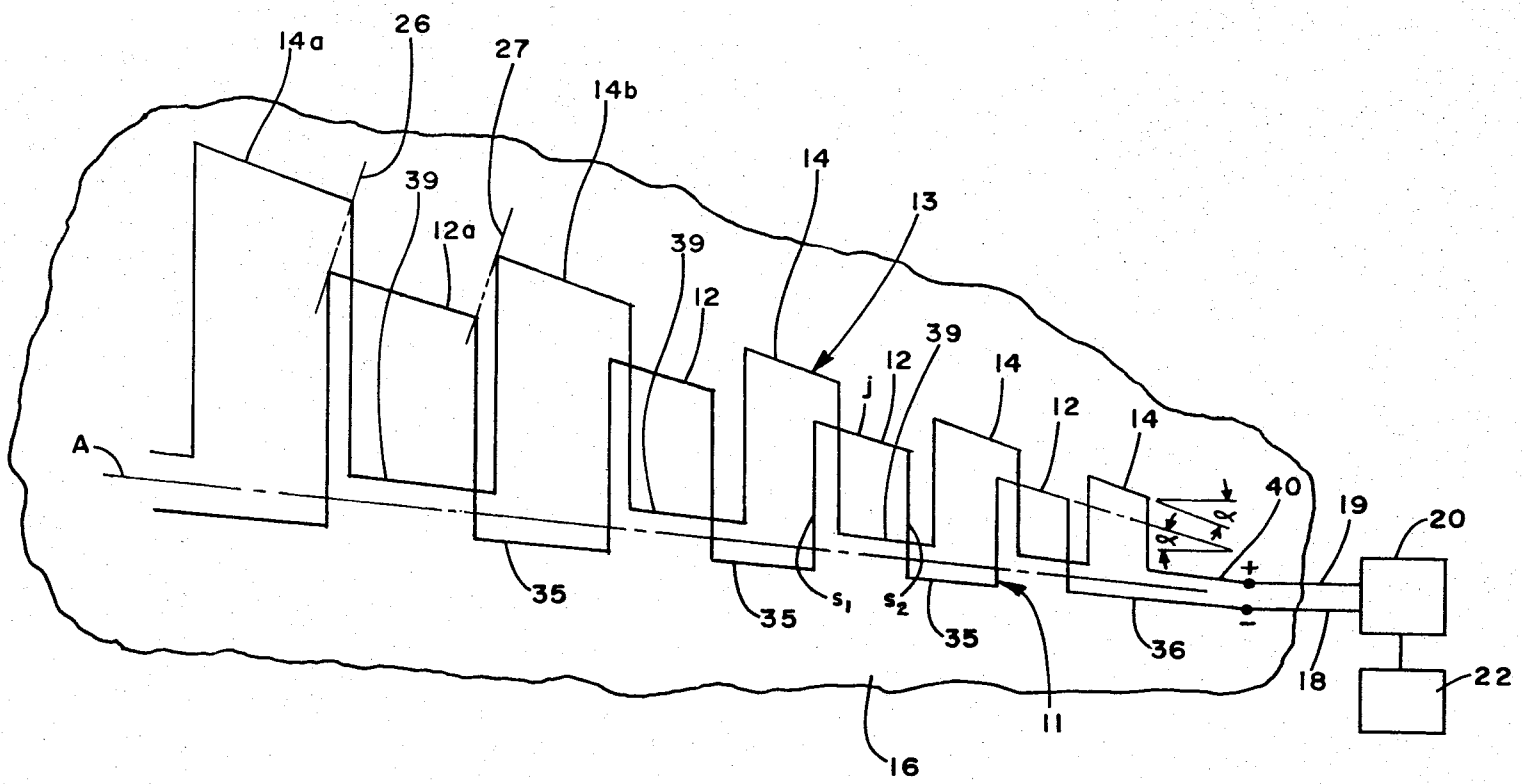
FIG. 1 is a schematic perspective view of a log-periodic monopole antenna embodying this invention.

Referring now to the drawings, FIG. 1 illustrates a preferred embodiment of the invention consisting of an antenna 10 having an axis A and comprising a first array 11 of elements 12 and a second array 13 of elements 14 disposed over a ground plane 16 such as the earth or a metallic sheet. Arrays 11 and 13 lie in closely spaced diverging planes which are perpendicular to ground plane 16 and are symmetrical about the central plane of the antenna which contains the antenna axis A. Arrays 11 and 13 are connected at one end by lines 18 and 19 to a balanced feed source 20 such as a magic-tee connected in turn to utilization apparatus 22 which may be a receiver or a transmitter.

The physical dimensions and spacings of the elements of each array vary in progressive increments of a predetermined ratio from a minimum size at the feed end to a maximum at the other end. This well-known log-periodic relationship is expressed as follows:

$$\frac{h_n}{h_{n-1}} = \frac{s_n}{s_{n-1}} = \tau \quad (1)$$

where h is the element height, s is adjacent element spacing and $\tau$ is a constant. The outer ends of elements 12 and 14 remote from the ground plane lie in a common plane which diverges from the ground plane at a predetermined taper angle $\alpha$ from the feed end of the antenna. The relative longitudinal positions of arrays 11 and 13 are such that a space between adjacent elements on one array is opposite an element of the other array wherein the width and depth of the space are equal to the width and height, respectively, of the element. For example, the largest element 12*a* of array 11 is positioned opposite the space between elements 14*a* and 14*b* of array 13, and the width and height of element 12*a* is equal to the width and depth of opposite space. This positional relationship of the two arrays is indicated by the broken lines 26 and 27 in FIG. 1 which intersect adjacent corners of adjacent elements as shown; lines 26 and 27 are parallel and extend substantially perpendicular to the central plane of the antenna.

Adjacent elements 12 of array 11 are interconnected at their lower ends by conductive connectors 35 and the smallest element of the array is connected by lead 36 to line 18 of balanced feed source 20. Elements 14 of array 13 are similarly interconnected by connectors 39 and lead 40 connects the smallest element of this array to the other line 19 of feed source 20. The plus and minus signs on leads 36 and 40 indicate that the two arrays are fed 180° out of phase.

The elements of both arrays have the same configuration, except for size, being open at the lower end adjacent to the ground plane and closed at the upper opposite end. In the preferred embodiment shown in FIG. 1, each element is trapezoidally shaped having longitudinally spaced parallel sides $s_1$ and $s_2$ interconnected remote from the ground plane by a jumper line j. Side $s_1$ of each element is longer than side $s_2$ such that jumper j is coincident with a straight line inclined at the taper angle $\alpha$ with the ground plane. The ends of sides $s_1$ and $s_2$ proximate to the ground plane are connected by connector lines 35 to adjacent elements. Thus, each array comprises an electrically continuous conductor which carries current from the feed source 20 to the active element for radiation from the antenna at the corresponding resonant frequency.

Figure 2:
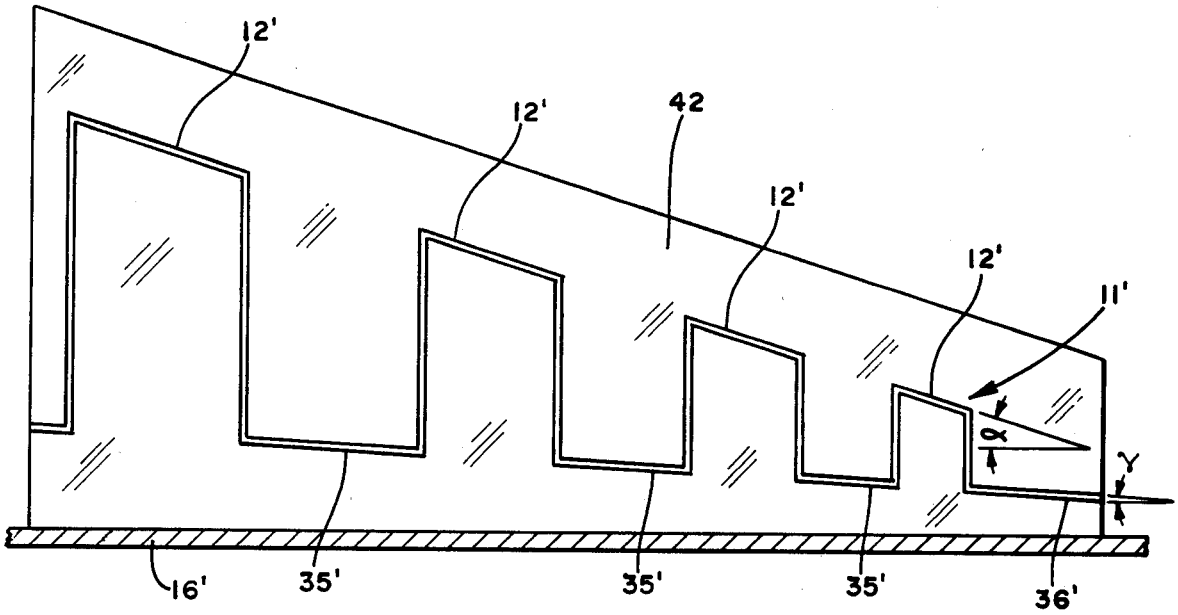
FIG. 2 is a side elevation of one of the antenna arrays mounted on a support over the ground plane.
Figure 3:
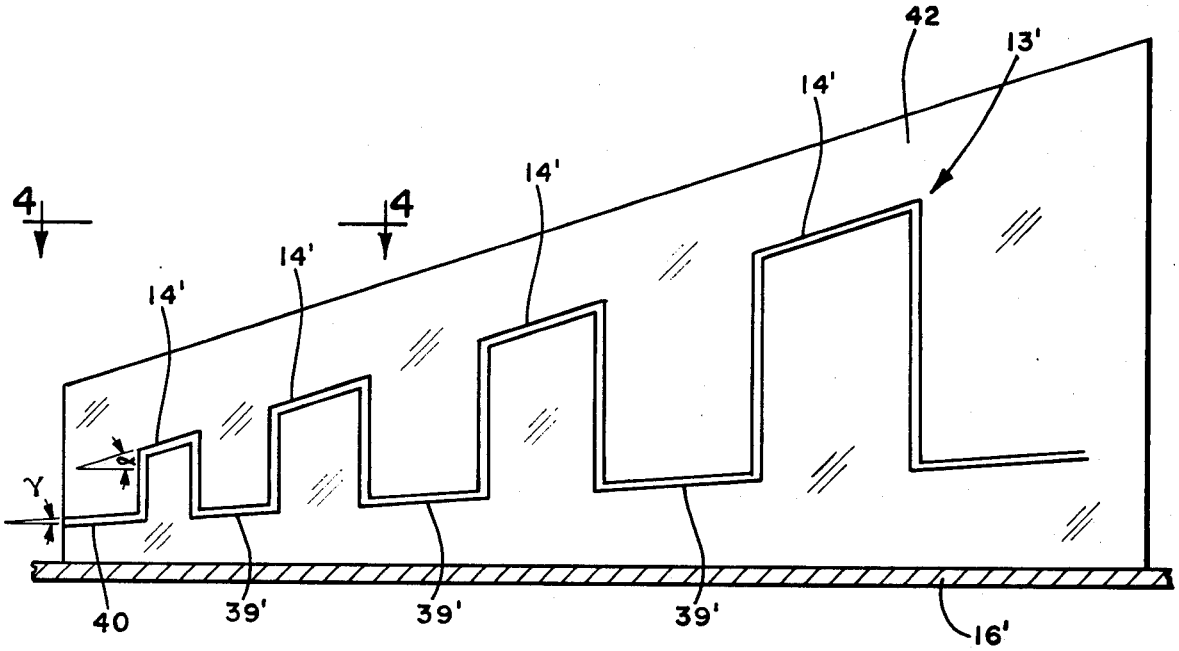
FIG. 3 is a view similar to FIG. 2 showing the second array on the other side of the antenna.
Figure 4:
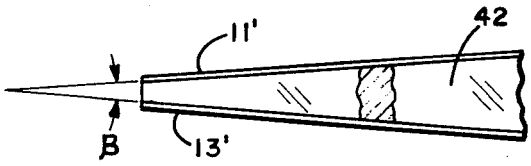
FIG. 4 is a top view of the antenna taken along line 4—4 of FIG. 3.

FIGS. 2, 3 and 4 illustrate one technique for supporting the arrays over the ground plane. Arrays 11' and 13' are the same as arrays 11 and 13 and are formed of wire-like conductors mounted on opposite sides of a wedge-shaped dielectric card 42; like parts on the drawings are indicated by the primes of like reference characters. Card 42 is mounted on and extends perpendicularly to conductive ground plane 16'. As shown in FIG. 4, the sides of dielectric card 42 diverge at an angle $\beta$ from the feed end of the antenna. Other techniques of supporting the arrays are mounting the arrays on separate dielectric sheets, suspending the arrays from tower supported guy wires and making the arrays of self-supporting rigid tubing or wire.

Interelement connectors 35' and 39' of arrays 11' and 13', respectively, lie in a common plane which diverges from the ground plane at an angle $\gamma$ as shown in FIGS. 2 and 3. The purpose of this vertical divergence $\gamma$ as well as the lateral divergence $\beta$ is to maintain a pseudo-constant antenna input impedance, patterns and gain over the full operating frequency range of the antenna.

The antenna is believed to operate in the following manner. The antenna elements are fed from the small element ends in a balanced manner so that the currents in the two arrays have opposite polarities. Since the currents on side legs $s_1$ and $s_2$ of each element are of opposite polarity, radiation does not occur from these legs because the currents cancel each other. However, radiation does occur from the electromagnetic fields set up between the jumper j of each element and the ground plane and since adjacent elements of the two arrays generate opposite electric fields, the condition for backfire radiation is present producing log-periodic performance of the antenna structure. Since radiation from each antenna element occurs over a region or area, i.e., the portion within the element defined by sides $s_1$, $s_2$ and jumper j, in contrast to a single wire dipole, the "Q" of the element is lower than that of a wire radiator and hence the instantaneous bandwidth of the element is substantially greater than that of a wire. The result is that the balanced-fed log-periodic monopole antenna has a larger active region over which the radiation occurs and therefore the efficiency of the antenna is greater than prior log-periodic monopole antennas. This low "Q" characteristic is believed to be responsible for the more predictable and repeatable antenna performance. In addition, construction tolerances for the antenna are broader without adversely affecting performance.

Another significant feature of the antenna embodying the invention is that the elements of each array are also part of the transmission line which feeds the array. This results from the structure in which the continuous feed conductor, preferably a wire, not only connects adjacent elements but also is configured to form each element with the lower part of the element being open. As a consequence, the feed conductors are not periodically loaded transmission lines because the elements along with interelement connectors comprise the transmission lines. This feature is believed to contribute substantially to the successful operation of the antenna.

An antenna of the type shown in FIG. 1 which has been built and successfully operated has the following physical parameters and performance characteristics:

| | |
|---|---|
| Frequency range | 500–1000 MHz |
| VSWR | <2:1 |
| Front to back ratio | 15 dB |
| Pattern gain | 6.5 dBi |
| Taper angles | |
| $\alpha$ | 25° |
| $\gamma$ | 3° |
| $\beta$ | 5° |
| Constant $\tau$ | 85 |
| Number of elements | |
| Array 11 | 9 |
| Array 13 | 10 |
| Average height of smallest element (array 13) | 4 cm |
| Width of smallest element | 1 cm |
| Average height of largest element (array 13) | 17.5 cm |
| Width of largest element | 4 cm |
| Average spacing from ground plane | .5 cm |
| Conductors (elements and connectors) | |
| Material | Brass |
| Size | 12 gauge |

-continued

| Balanced feed source | Magic-tee |
|---|---|

Figure 5:
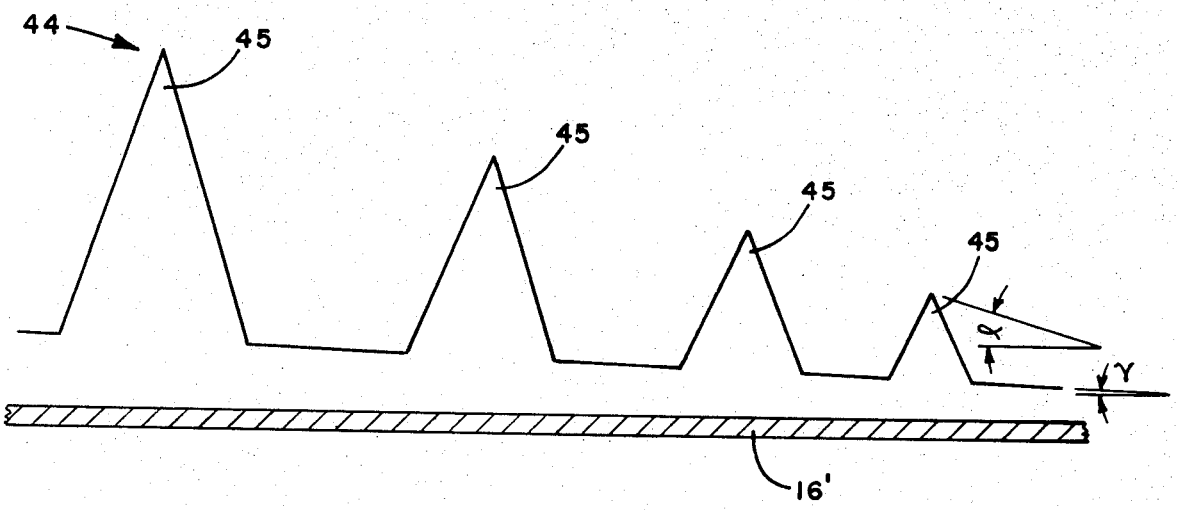
FIGS. 5 and 6 are schematic views similar to FIG. 2 showing modified forms of the invention with triangular and pseudo-trapezoidally shaped elements, respectively.
Figure 6:
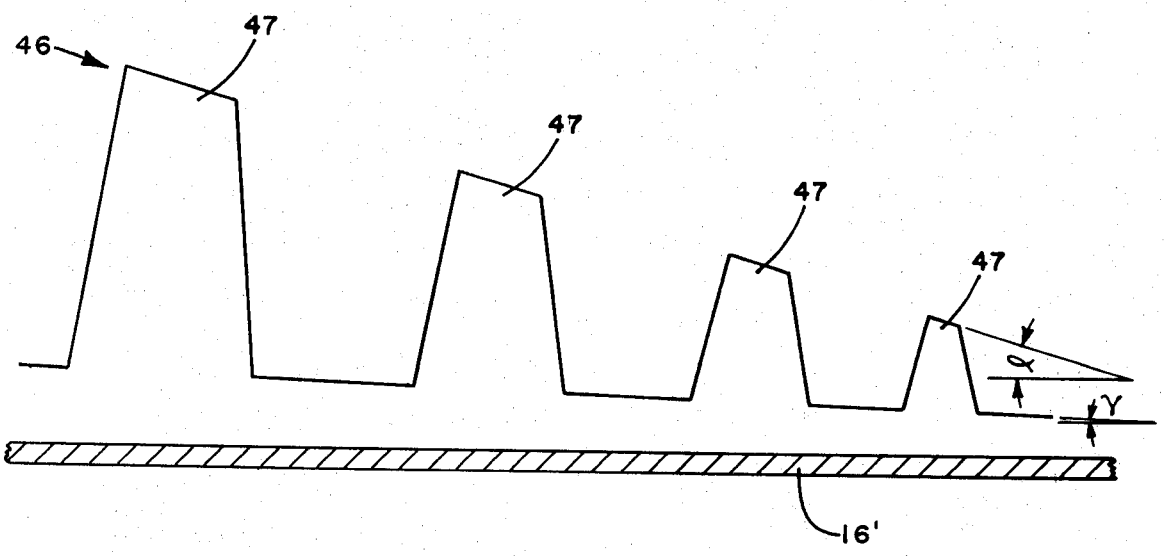

In addition to the trapezoidal shape of the antenna elements of FIGS. 1–3, other geometries of the elements are useful in the practice of the invention. These include the antenna 44 shown in FIG. 5 with triangular elements 45 and the antenna 46 shown in FIG. 6 having pseudo-trapezoidally shaped elements 47 in which the element sides are not parallel. It should be noted, however, that the efficiency of antenna operation decreases with the diminished area within an element. Therefore, the antenna of FIG. 1 has a higher pattern gain and better impedance response than the antennas of FIGS. 5 and 6.

What is claimed is:

1. A balanced-fed log-periodic vertically polarized monopole antenna comprising first and second angularly spaced arrays proximately spaced from and on the same side of an electrically conductive ground plane, each of said arrays comprising a plurality of longitudinally spaced radiating elements and interelement connector lines connecting said elements in series, said elements of each array extending in a direction away from and in a plane normal to said ground plane, each of said elements being open at the inner end proximate to the ground plane and closed at the outer end remote from the ground plane, the elements of each of said arrays having dimensions which progressively increase from one end to the other in progressive increments of a predetermined ratio, the space between adjacent elements of one of said arrays being opposite an element of the other of said arrays, and means to connect said one ends of said arrays to a balanced feed source.

2. The antenna according to claim 1 in which each of said arrays comprise an electrically continuous wire-like conductor.

3. The antenna according to claim 1 in which the interelement spacing of each array progressively increases from said one end in increments of said predetermined ratio, the width of the space between adjacent elements of one array being equal to the width of the opposite element of the other array.

4. The antenna according to claim 3 in which the planes of said arrays diverge from each other from said one ends thereof, said connector lines of said arrays lying in a plane diverging from said ground plane from said one ends of the arrays.

5. The antenna according to claim 3 in which each of said elements has two sides connected to the adjacent connector lines, respectively, and disconnected from each other adjacent to the ground plane.

6. The antenna according to claim 5 in which said element sides are parallel, and a conductive jumper interconnecting the ends of said sides of each element remote from said line conductor.

7. The antenna according to claim 5 in which said elements have triangular shapes.

8. A log-periodic vertically polarized monopole antenna comprising first and second juxtaposed arrays spaced proximate to and perpendicular to an electrically conductive ground plane, each array comprising a plurality of radiating elements electrically connected in series with and at predetermined longitudinally spaced intervals, each of said elements being open adjacent to the ground plane, the space between adjacent elements of one of said arrays being opposite an element of the other of said arrays, the dimensions of and spacing between said elements of each array increasing from one end to the other in progressive increments of a predetermined ratio, and balanced feeding means connected to said one end of each of said first and second arrays for feeding same out of phase.

9. The antenna according to claim 8 with connectors electrically interconnecting adjacent elements, respectively, of each array, said connectors and said elements of each array comprising a continuous electrical conductor.

10. The antenna according to claim 8 in which each element is defined by two conductive legs connected to the associated connectors and extending away from said ground plane, said legs of each element being electrically connected together remote from the ground plane and being electrically disconnected from each other at said connectors.

11. The antenna according to claim 10 in which said legs of each element intersect each other.

12. The antenna according to claim 10 in which said legs of each element are interconnected remote from the ground plane by a transverse jumper.

13. The antenna according to claim 12 in which said legs of each element are parallel.

14. A log-periodic vertically polarized monopole antenna comprising first and second juxtaposed arrays closely spaced from and perpendicular to one side of an electrically conductive ground plane whereby to produce mirror images of said arrays on the opposite side of the ground plane, each array having a transmission line comprising a plurality of longitudinally spaced radiating elements and connectors electrically connecting adjacent elements, the elements of each array having dimensions and interelement spacings increasing from one end to the other in progressive increments of a predetermined ratio, balanced feed means comprising a feed line connected to each of said one ends of said transmission lines whereby said arrays and said images thereof have four feed points, respectively, and utilization apparatus connected to said feed means.

* * * * *